US009210495B2

(12) United States Patent
Akino

(10) Patent No.: US 9,210,495 B2
(45) Date of Patent: Dec. 8, 2015

(54) DYNAMIC HEADPHONES

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/336,374

(22) Filed: Jul. 21, 2014

(65) Prior Publication Data

US 2015/0117693 A1 Apr. 30, 2015

(30) Foreign Application Priority Data

Oct. 28, 2013 (JP) ..... 2013-223427

(51) Int. Cl.
*H04R 25/00* (2006.01)
*H04R 1/10* (2006.01)
*H04R 1/28* (2006.01)

(52) U.S. Cl.
CPC ..... *H04R 1/1058* (2013.01); *H04R 1/1008* (2013.01); *H04R 1/1075* (2013.01); *H04R 1/28* (2013.01)

(58) Field of Classification Search
CPC .. H04R 1/1008; H04R 1/1083; H04R 1/1091; H04R 5/033; H04R 2460/01; H04R 1/1075; H04R 1/1066; H04R 1/1016; H04R 2201/10; G10K 2210/1081; G10K 1/1788
USPC ..... 381/370, 371, 372, 373, 374, 375, 376, 381/71.6, 71.7, 386; 29/594
See application file for complete search history.

(56) References Cited

U.S. PATENT DOCUMENTS 6,412,593 B1 * 7/2002 Jones ..... 181/129
2011/0286607 A1 * 11/2011 Kimura ..... 381/71.6

FOREIGN PATENT DOCUMENTS

JP 2013-042382 A 2/2013

* cited by examiner

*Primary Examiner* — Sunita Joshi
(74) *Attorney, Agent, or Firm* — Manabu Kanesaka

(57) ABSTRACT

Provided is a dynamic headphone that has a small size but makes a larger-diameter headphone unit mountable thereon, the dynamic headphone including a highly reliable acoustic channel that acoustically connects a front air chamber and a back air chamber to each other. A headphone case 20 houses a headphone unit 50 therein, and includes a back air chamber C2 on a back side of the headphone unit 50. The headphone case 20 includes: a back air chamber forming portion 40 that forms the back air chamber C2; and a mount portion 30 integrally provided to an opening end of the back air chamber forming portion 40, the headphone unit 50 being mounted in the mount portion 30. An acoustic channel 70 is provided between the mount portion 30 and the headphone unit 50.

6 Claims, 2 Drawing Sheets

DYNAMIC HEADPHONES

CROSS-REFERENCE TO RELATED APPLICATION

The present application is based on, and claims priority from, Japanese Application Serial Number JP2013-223427, filed Oct. 28, 2013, the disclosure of which is hereby incorporated by reference herein in its entirety.

TECHNICAL FIELD

The present invention relates to an over-the-head type dynamic headphone that is fitted to a head side part so as to cover an ear, and, more specifically, to a dynamic headphone on which a large-diameter headphone unit is mountable without an increase in size of a headphone case.

BACKGROUND ART

Headphones are classified broadly into three types, that is, an over-the-head type in which a headphone is held by a headband, an ear-hook type in which a headphone is held by being hooked on an ear, and an ear-insertion type in which a headphone is held by being directly inserted into an ear.

Among these types, the over-the-head type headphone is popular for the following reasons: high sound quality is obtained because of the use of a headphone case large enough to cover the entire ear; and even long-time fitting puts a low load on the ear.

According to a first conventional example of the over-the-head type headphone, as illustrated in FIG. 3A, an over-the-head type headphone 1A includes a headphone band (not illustrated) that is fitted along a head H in an arch-like manner, and a headphone case 2 is suspended at each end of the headband.

A headphone unit 3 is housed in the headphone case 2 while being supported by a baffle plate 4. A doughnut-shaped ear pad 5 to be placed around an ear E at the time of fitting of the headphone is integrally attached to a sound emitting surface of the headphone case 2. In many cases, a dynamic electro-acoustic transducer is adopted for the headphone unit 3.

In the headphone case 2, a back air chamber C2 having a predetermined volume is formed by the baffle plate 4 on a back side of the headphone unit 3, and a substantially hermetically sealed front air chamber C1 is formed by the ear pad 5 also on a front side of the headphone unit 3 at the time of fitting of the headphone.

In the headphone 1A of this type, the following is a common practice to attenuate in-head localization of sound images and improve sound quality and frequency response. That is, an acoustic channel 6 is provided to part of the baffle plate 4, an acoustic resistance material 6*a* such as non-woven fabric is attached to the acoustic channel 6, and the front air chamber C1 and the back air chamber C2 are acoustically connected to each other.

Meanwhile, in order to obtain a headphone having excellent sound quality, it is preferable to increase the diameter of the headphone unit 3 as much as possible. If a large-diameter headphone unit 3 is mounted as it is on the headphone 1A having the configuration illustrated in FIG. 3A, however, the size of the headphone case 2 increases accordingly, and the portability thereof is impaired.

For the purpose of avoiding the portability thereof from being impaired, in order to mount the large-diameter headphone unit 3 without such an increase in size of the headphone case 2, the acoustic channel 6 provided to the baffle plate 4 needs to be placed in the vicinity of the lower side of the ear pad 5 (the side of the ear pad 5 opposed to the baffle plate 4).

If such a design is adopted, however, the acoustic channel 6 may be closed by the ear pad 5, depending on a lateral pressure applied when the headphone is fitted to the head H.

In view of the above, in a headphone 1B (second conventional example) according to an invention described in Japanese Patent Application Publication No. 2013-42382, which is illustrated in FIG. 3B, in order to make a larger-diameter headphone unit 3 mountable, a communication groove 4*a* is formed in the baffle plate 4 in the case where the acoustic channel 6 provided to the baffle plate 4 is placed on the lower side of the ear pad 5. The communication groove 4*a* is communicated with the acoustic channel 6, and is deep enough not to be closed by the ear pad 5.

According to Japanese Patent Application Publication No. 2013-42382, it is possible to provide a headphone that has a small size but includes the large-diameter headphone unit 3, in which the acoustic channel 6 is hardly closed by the ear pad 5. However, because the headphone still includes the baffle plate 4, there is a limit to an increase in diameter of the headphone unit 3. Moreover, because it is necessary to form, in the baffle plate 4, the communication groove 4*a* that is deep enough not to be closed by the ear pad 5, production costs become higher accordingly.

Under the circumstances, the present invention has an object to provide a dynamic headphone that has a small size but makes a larger-diameter headphone unit mountable thereon, the dynamic headphone including a highly reliable acoustic channel that acoustically connects a front air chamber and a back air chamber to each other.

SUMMARY OF THE INVENTION

In order to achieve the above-mentioned object, the present invention provides a dynamic headphone including: a headphone unit including: a diaphragm including a voice coil; a magnetic circuit portion including a magnetic gap in which the voice coil is placed; and a unit frame that supports the diaphragm and the magnetic circuit portion; a headphone case that houses the headphone unit therein while securing a back air chamber having a predetermined volume on a back side of the headphone unit; an ear pad that is provided to an outer peripheral edge part of the headphone case so as to: surround an ear on a sound emitting surface side of the headphone unit; and form a front air chamber having a predetermined volume on a front side of the headphone unit, when the dynamic headphone is fitted to a head side part of a human body; and an acoustic channel that acoustically connects the front air chamber and the back air chamber to each other. The headphone case includes: a back air chamber forming portion that forms the back air chamber; and a mount portion integrally provided to an opening end of the back air chamber forming portion, the headphone unit being mounted in the mount portion. The acoustic channel is provided between the mount portion and the headphone unit.

According to a preferable aspect of the present invention, the mount portion includes: a cylindrical portion having a diameter larger than that of the unit frame; and an engagement portion that is bent inward from a front end of the cylindrical portion so as to be opposed to a peripheral edge part of the unit frame, and the acoustic channel is placed along inner surfaces of the engagement portion and the cylindrical portion.

Moreover, the present invention includes, as preferable aspects: an aspect in which a predetermined acoustic resistance material is provided in the acoustic channel; and an aspect in which the ear pad is provided on an outer surface side of the engagement portion.

According to the present invention, the headphone case includes: the dome portion that substantially forms the back air chamber; and the mount portion integrally provided to the opening end of the dome portion, the headphone unit being mounted in the mount portion. Hence, the headphone unit is directly mounted in the mount portion, and a baffle plate is not necessary, whereby a larger-diameter headphone unit can be mounted. Moreover, because the acoustic channel is provided between the mount portion and the headphone unit, the acoustic channel is not closed by the ear pad and the like, and thus has high reliability.

DETAILED DESCRIPTION

An embodiment of the present invention is described with reference to FIG. 1 and FIG. 2, and the present invention is not limited to the embodiment.

Figure 1:
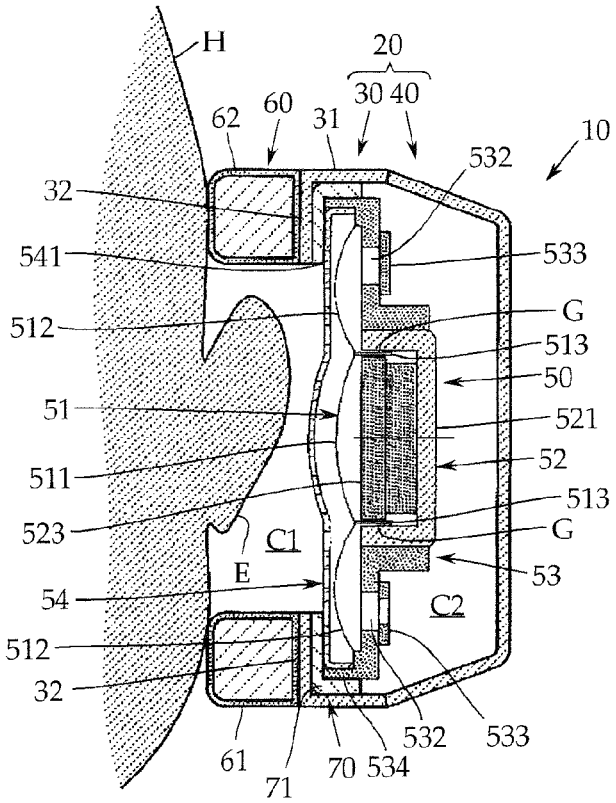
FIG. 1 is a main part cross-sectional view illustrating a dynamic headphone according to an embodiment of the present invention.

As illustrated in FIG. 1, a dynamic headphone 10 according to the present embodiment is of over-the-head type, and includes a headphone case 20 that is suspended at each end of a headband (not illustrated) with the intermediation of a universal-joint-like hanger member (not illustrated). The headband is fitted along a head H of a user from a head top part to each head side part. Note that a pair of right and left headphone cases 20 is supported by the headband, and only one thereof is illustrated in FIG. 1, because the right and left headphone cases 20 have the same configuration as each other.

The headband may be a general U-shaped headband that is fitted along the head H from the head top part to each head side part, and may also be, for example, of behind-the-head type in which the headphone is held by fitting the headband along a head back part.

In the present embodiment, the headphone case 20 includes: a mount portion 30 in which a headphone unit 50 is mounted; and a dome portion 40 formed in a substantially cup shape, the dome portion 40 corresponding to a back air chamber forming portion that forms a back air chamber C2 having a predetermined volume on a back side of the headphone unit 50. The mount portion 30 is integrally attached to an opening end of the dome portion 40. The material of each of the mount portion 30 and the dome portion 40 may be selected from synthetic resin materials, metal materials, and wood materials.

The headphone unit 50 is a dynamic electro-acoustic transducer, and includes a diaphragm 51, a magnetic circuit portion 52 for driving, and a unit frame 53 that supports the diaphragm 51 and the magnetic circuit portion 52.

The diaphragm 51 includes a center dome 511 and a sub-dome (also referred to as edge portion) 512 that is integrally provided in a continuous manner around the center dome 511. A voice coil 513 is integrally attached using an adhesive or the like to a joint part between the center dome 511 and the sub-dome 512, on a back side of the diaphragm 51.

The magnetic circuit portion 52 includes: a dish-like yoke 521 formed in a substantially U-shape in cross-section; and a discoid permanent magnet 522 that is placed in a bottom part of the yoke 521 and is magnetized in a plate thickness direction. A pole piece 523 is provided on the permanent magnet 522, and the pole piece 523 forms a magnetic gap G having a predetermined width between the pole piece 523 and an inner peripheral surface of the yoke 521.

The entire unit frame 53 is formed in a discoid shape. The unit frame 53 includes, in the center thereof, an opening portion 531 that houses and supports the magnetic circuit portion 52 and is made of a cylindrical sleeve. A peripheral edge part of the sub-dome 512 of the diaphragm 51 is supported by a peripheral edge part of the unit frame 53 such that the voice coil 513 can vibrate in the magnetic gap G of the magnetic circuit portion 52.

Moreover, the unit frame 53 is provided with a plurality of communication holes 532 for communicating an air chamber on the back side of the diaphragm 51 with the back air chamber C2. An acoustic resistance material 533 such as non-woven fabric is attached to each communication hole 532, whereby predetermined damping is applied to the diaphragm 51.

Further, a protector 54 having a large number of through-holes 541 for protecting the diaphragm 51 is provided on a front surface (in FIG. 1, a left surface) of the unit frame 53. Perforated metal, metal mesh (guard mesh), and the like may be used for the protector 54. In the present embodiment, a sleeve 534 into which the protector 54 is fitted is provided in a standing manner to the peripheral edge part of the unit frame 53.

Figure 2:
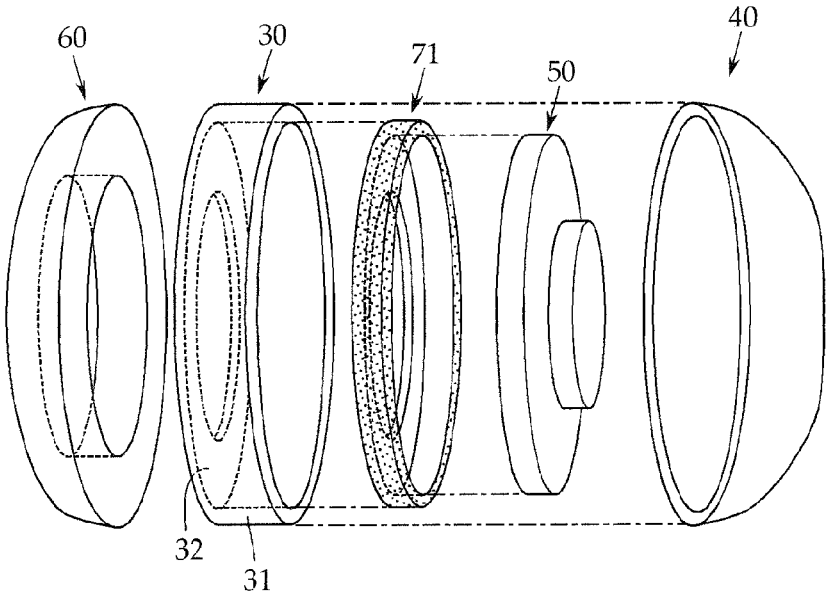
FIG. 2 is an exploded perspective view schematically illustrating a structure of the dynamic headphone.
Figure 3A:
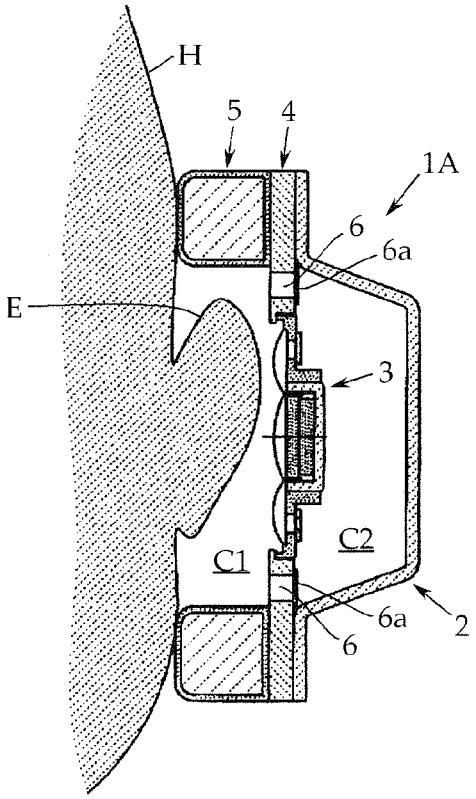
FIG. 3A (PRIOR ART)
FIG. 3A is a main part cross-sectional view illustrating a first conventional example.
Figure 3B:
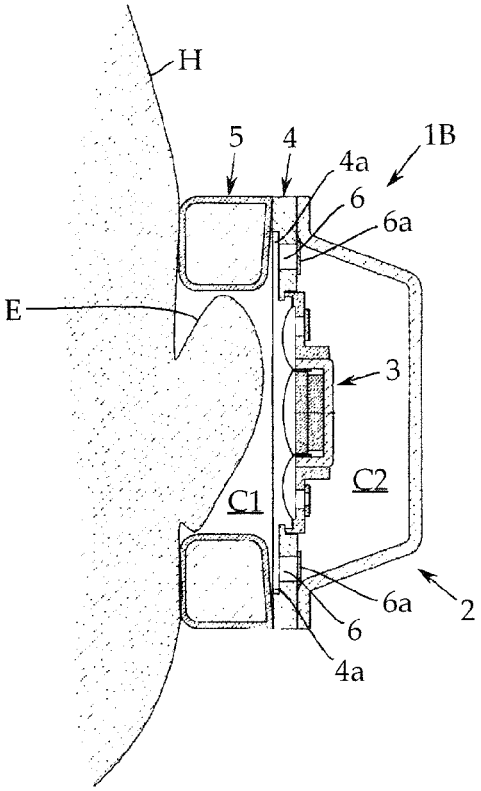
FIG. 3B (PRIOR ART)
FIG. 3B is a main part cross-sectional view illustrating a second conventional example.

Also with reference to FIG. 2, the mount portion 30 includes: a cylindrical portion 31 having a diameter larger than that of the unit frame 53; and an engagement portion 32 for receiving the unit frame 53, the engagement portion 32 being bent inward (toward the center of the cylindrical portion 31) from a front end (in FIG. 1 and FIG. 2, a left end) of the cylindrical portion 31 so as to be opposed to the peripheral edge part of the unit frame 53.

In the present embodiment, as illustrated in FIG. 2, the engagement portion 32 is formed in a circular plate (washer-like shape) having an opened central part, and may be made of a plurality of nail pieces that are bent inward at predetermined intervals from the front end of the cylindrical portion 31.

Moreover, although the engagement portion 32 is bent from the front end of the cylindrical portion 31 in the present embodiment, the engagement portion 32 may be formed as an independent member, and may be joined to the front end of the cylindrical portion 31 by using an adhesive, welding, or the like.

In the present embodiment, an ear pad 60 is integrally attached to an outer surface of the engagement portion 32. The ear pad 60 may be a pad obtained by covering a cushioned foam core 61 formed in an annular shape with, for example, a cover material 62 made of synthetic leather.

At the time of fitting of the headphone, the ear pad 60 is pressed against the head side part at a predetermined lateral pressure applied by the headband so as to surround the ear E, whereby a substantially hermetically sealed front air chamber C1 is formed on a front side of the headphone unit 50.

In the case where the headphone unit 50 is mounted in the mount portion 30, in the present invention, a baffle plate is not necessary, and the headphone unit 50 is directly housed in the mount portion 30.

Moreover, an acoustic channel (an acoustic channel that acoustically connects the front air chamber C1 and the back air chamber C2 to each other) 70 for attenuating in-head localization of sound images and improving sound quality and frequency response is provided in the mount portion 30.

Accordingly, in the present embodiment, because the cylindrical portion 31 of the mount portion 30 has a diameter larger than that of the unit frame 53 of the headphone unit 50, for example, an acoustic resistance material 71 that is made of felt or the like and has an L-shape in cross-section is provided in an annular shape to an inner surface of the cylindrical portion 31 and an inner surface of the engagement portion 32, and the headphone unit 50 is then mounted (housed) in the mount portion 30, whereby the acoustic channel 70 is formed. It is assumed that the respective widths of the annular parts of the ear pad 60 and the acoustic resistance material 71 and the width of the engagement portion 32 are the same as illustrated in FIG. 1.

According to this configuration, the headphone unit 50 having a large diameter close to the outer diameter of the ear pad 60 can be mounted. Moreover, because the acoustic channel 70 is placed in the mount portion 30 that is not influenced by the ear pad 60, the acoustic channel 70 having high reliability can be secured.

In the above-mentioned embodiment, a gap serving as the acoustic channel 70 is provided between the mount portion 30 and the unit frame 53 by means of the acoustic resistance material 71. Alternatively, according to another embodiment, for example, ribs each having a predetermined height may be formed on the inner surfaces of the cylindrical portion 31 and the engagement portion 32, the acoustic channel 70 may be defined by a gap formed by the ribs, and the acoustic resistance material 71 having a predetermined acoustic resistance value may be placed in the acoustic channel 70. Such an embodiment is also included in the present invention.

Moreover, in the above-mentioned embodiment, the back air chamber C2 is substantially formed by the cup-shaped dome portion 40. Alternatively, according to another embodiment, the cylindrical portion 31 of the mount portion 30 may be extended in the axial direction by a predetermined length up to the back side of the headphone unit 50, and a back end part of the cylindrical portion 31 may be included in an element for forming the back air chamber C2.

According to the another embodiment, the back air chamber forming portion is constituted by the dome portion 40 and part of the mount portion 30. Still alternatively, the back end part of the cylindrical portion 31 of the mount portion 30 may be closed by a cover plate or the like, whereby the back air chamber C2 may be formed. In this case, the dome portion 40 is not necessary, and hence the back air chamber forming portion is constituted by the mount portion 30.

The invention claimed is:

1. A dynamic headphone comprising:

a headphone unit including: a diaphragm including a voice coil; a magnetic circuit portion including a magnetic gap in which the voice coil is placed; and a unit frame that supports the diaphragm and the magnetic circuit portion;

a headphone case that houses the headphone unit therein, and includes a back air chamber forming portion forming a back air chamber having a predetermined volume on a back side of the headphone unit, and a mount portion integrally provided to an opening end of the back air chamber forming portion, the headphone unit being mounted in the mount portion, wherein the mount portion includes a cylindrical portion having a diameter larger than that of the unit frame, and an engagement portion bent inward from a front end of the cylindrical portion to face a peripheral edge part of the unit frame;

an ear pad that is provided to an outer peripheral edge part of the headphone case and adapted to surround an ear of a wearer on a sound emitting surface side of the headphone unit, the ear pad being adapted to form a front air chamber having a predetermined volume between the ear and a front side of the headphone unit when the dynamic headphone is fitted over the ear of the wearer;

an acoustic channel provided between the mount portion and the headphone unit, extending along inner surfaces of the engagement portion and the cylindrical portion to acoustically connect the front air chamber and the back air chamber to each other; and an acoustic resistance material provided in the acoustic channel.

2. The dynamic headphone according to claim 1, wherein the ear pad is provided on an outer surface side of the engagement portion.

3. The dynamic headphone according to claim 1, wherein the engagement portion is arranged on the ear pad, and the cylindrical portion extends from an outer peripheral edge of the engagement portion to integrally connect with the opening end of the back air chamber forming portion so that the acoustic channel is formed to communicate between the back air chamber and the front air chamber.

4. The dynamic headphone according to claim 3, further comprising a protector disposed over the front side of the headphone unit to protect the diaphragm, wherein the unit frame includes a sleeve formed at a peripheral edge thereof to surround and fit the protector.

5. The dynamic headphone according to claim 4, wherein the protector has a circular shape in which a diameter is less than that of the unit frame to fit into the sleeve of the unit frame.

6. The dynamic headphone according to claim 5, wherein the acoustic resistance material has an annular shape with an outer peripheral edge extending along the cylindrical portion of the mount portion, so that the acoustic resistance material is disposed between an outer side of the sleeve of the unit frame and the cylindrical portion of the mount portion, and between the protector and the engagement portion of the mount portion.

* * * * *